US005228140A

United States Patent [19]

Baustin

[11] Patent Number: 5,228,140

[45] Date of Patent: Jul. 20, 1993

[54] SANITARY GARMENT

[76] Inventor: Michel M. Baustin, 1066 E. 81st St., Brooklyn, N.Y. 11236

[21] Appl. No.: 916,166

[22] Filed: Jul. 17, 1992

Related U.S. Application Data

[63] Continuation-in-part of Ser. No. 735,862, Jul. 25, 1991, Pat. No. 5,138,715.

[51] Int. Cl.[5] ..... A41D 3/02

[52] U.S. Cl. ..... 2/93; 2/85; 2/88; 2/96; 2/247

[58] Field of Search ..... 2/85, 88, 93, 94, 96, 2/101, 115, 247, 69, 69.5, 104, DIG. 7, 97, 125; 128/77; 623/57; 446/26, 28

[56] References Cited

U.S. PATENT DOCUMENTS

| | | | |
|---|---|---|---|
| 1,010,679 | 12/1911 | Padernacht | 2/93 |
| 1,387,937 | 8/1921 | Paull | 2/88 |
| 2,144,875 | 1/1939 | Forrest | 2/93 |
| 2,475,058 | 7/1949 | Sheard | 2/93 |
| 2,715,226 | 8/1955 | Weiner | 2/93 |
| 2,717,391 | 9/1955 | Bracken | 2/94 |
| 3,026,527 | 3/1962 | Polk | 2/94 |
| 4,722,098 | 2/1988 | Stapeleton | 446/28 |
| 4,824,097 | 4/1989 | Axtell | 446/26 |
| 4,882,786 | 11/1989 | Gross | 2/94 |

*Primary Examiner*—Clifford D. Crowder
*Assistant Examiner*—Amy Brooke Vanatta

[57] ABSTRACT

A sanitary garment comprising a coat having sleeve slits in the elbow area that permit a person's hands and forearms to exit the sleeves, and body part slits adjacent the sleeve slits to allow the person's hands and forearms to be inserted in the body part of the coat, and a simulated hand attached to the end of one of the sleeves whereby a person can relieve himself in private and in an inconspicuous manner when a public toilet or restroom is not available.

6 Claims, 1 Drawing Sheet

SANITARY GARMENT

This is a continuation-in-part application of application Ser. No. 735,862 filed Jul. 25, 1991, now U.S. Pat. No. 5,138,715, which is incorporated herein by reference.

FIELD OF THE INVENTION

This invention relates to a sanitary garment, and more particularly to a garment that, in the absence of an available public toilet or restroom, can be worn by a man as an outer garment or coat and used in a sanitary fashion and inconspiculously when the man is confronted with the need to relieve himself.

BACKGROUND OF THE INVENTION

The scarcity of public toilets or restrooms has caused a great deal of discomfort and annoyance to countless numbers of people who need the convenience of such facilities. This is especially true in urban areas. The civic problem created by such scarcity and the public nuisance resulting therefrom has been exacerbated by the fact that even among those public toilets provided in subway stations and parks many have been closed because of vandalism and misuse. The consequences of this situation is an increasing incidence of public urination with its accompanying demeaning of city life.

This overall problem has led to increasing demands for the installation of sidewalk toilet booths of the type that are presently being installed in Paris and London by their French and British manufacturers, as well as other measures to overcome the problem.

The sanitary garment provided by the invention is suitable for men who experience difficulty in bladder control, or who frequently travel in busy areas that lack "comfort" facilities, and especially for older men who have medical problems or who are taking medications such as diuretics, and who are sensitive to the problems heretofor mentioned.

Applicant is unaware of an prior art relating to the subject matter of the invention. However, the following statement was noted in a New York Times editorial on Nov. 5, 1990 calling for the provision of sidewalk toilet booths, "By the 18th century, some European cities were reduced to reliance on street vendors who offered the use of buckets and the privacy of a voluminous cloak." Because of the antiquity of the arrangement referred to and the absence of any intervening improvements, applicant does not believe that the use of a bucket and voluminous cloak is pertinent prior art so far as the present invention is concerned.

GENERAL DESCRIPTION OF THE INVENTION

It is the object of the invention to provide a garment that, when worn by a person, enables that person to relieve himself in private and inconspiculously when in a generally public ambience.

It is another object of the invention to provide a garment that, when worn by a person, gives the appearance of that person wearing a conventional outer coat with his hands by his side outside the coat even when, in fact, his hands are within the garment.

In carrying out the invention, a generally conventional front opening outer coat having the usual body part and appended sleeves is provided with simulated hands sewn or otherwise attached to the cuffs of the sleeves. The sleeves are provided with slits at the inner side of the elbow region of the sleeves so that when the garment is put on, the person's hands and forearms may exit from the sleeves through the slits. Adjacent to the slits provided in the sleeves of the garment will be slits provided in the body part of the garment so that the hands and forearms of a person that exited from the slits in the sleeves may be inserted through the slits provided in the body part of the garment so that the person's hands and forearms are placed within the body part of the garment. However, to a viewer, the simulated hands attached to the cuffs of the sleeves of the garment would make it appear that the wearer of the garment has his hands at his side outside the garment. The garment is also provided with button means or a zipper that enables the qarment to be closed by the wearer from within or from outside the qarment, and with an interior pocket for holding or storing a suitable container that is used to collect urine.

Features and advantages of the invention may be gained from the foregoing and from the description of a preferred embodiment thereof which follows.

DETAILED DESCRIPTION OF THE INVENTION

Figure 1:
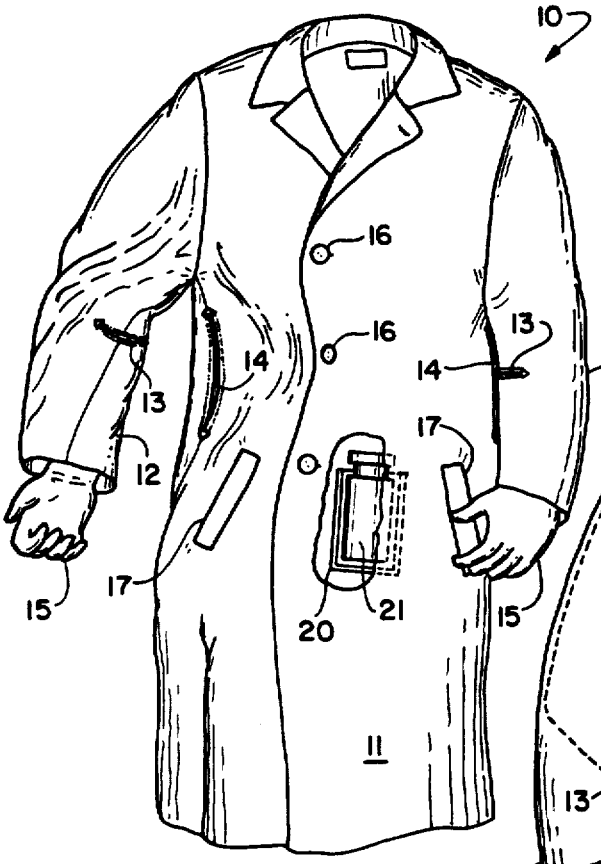
FIG. 1 is an illustration of the garment of the present invention, the right side of which is "turned out" to reveal pertinent features of the invention.

Referring to FIG. 1, a garment 10 is shown that generally resembles a conventional front opening raincoat or topcoat having a body part 11 with appended full length sleeves 12. The sleeves 12 of the garment, however, are provided with horizontal slits at the elbow region of the sleeves on the inner sides of the sleeves adjacent the body part of the garment. Generally aligned with the horizontal slits 13 are vertically arranged slits 14 provided in the body part 11 of garment 10. The arrangement is such that when a person wears the garment his hands and forearms may exit sleeves 12 through slits 13 and be inserted within or under the body part 11 of garment 10 through slits 14.

The front opening of garment 10 may be closed by button means 16 or a zipper manipulated by the wearer from outside the garment before he inserts his hands and forearms through slits 14, or closure means such as a zipper or Velcro means, could be manipulated from within the garment after the wearer's hands and forearms are inserted through slits 14.

Thus, garment 10 may be worn by a person with that person's hands and forearms inconspiculously placed within the qarment. However, to give the appearance of a person wearing a coat in the normal fashion with his hands outside the body part of the coat, simulated hands 15 are appended to the bottoms of sleeves 12. Hands 15 and the lower portion of sleeves 12 below slits 13 may be padded to enhance the illusion that, when in use, the garment is being worn by a person with his arms extending through the full length of the sleeves and his hands projecting from the sleeves just as they would if he were wearing a regular topcoat or raincoat.

Hands 15 may be sewn to the bottoms of sleeves 12 or they may be removably secured thereto by snaps or buttons. The simulated hands 15 may be three dimensional, and they may be formed of a molded plastic, or they may be simpler simulations that appear to be hands when seen from a distance. A simulated hand 15 may be provided on one sleeve and the other sleeve may be tucked into an outer pocket 17 on garment 10 to give the illusion that the wearer of the garment has one hand in pocket 17 and the other hand at his side outside garment 10 when, in fact both hands are inside the body part of the garment.

An internal pocket 20 is provided for storing a closable container 21 that is suitable for collecting urine and holding it without possibility of spillage for later disposal in a proper manner.

Figure 2:
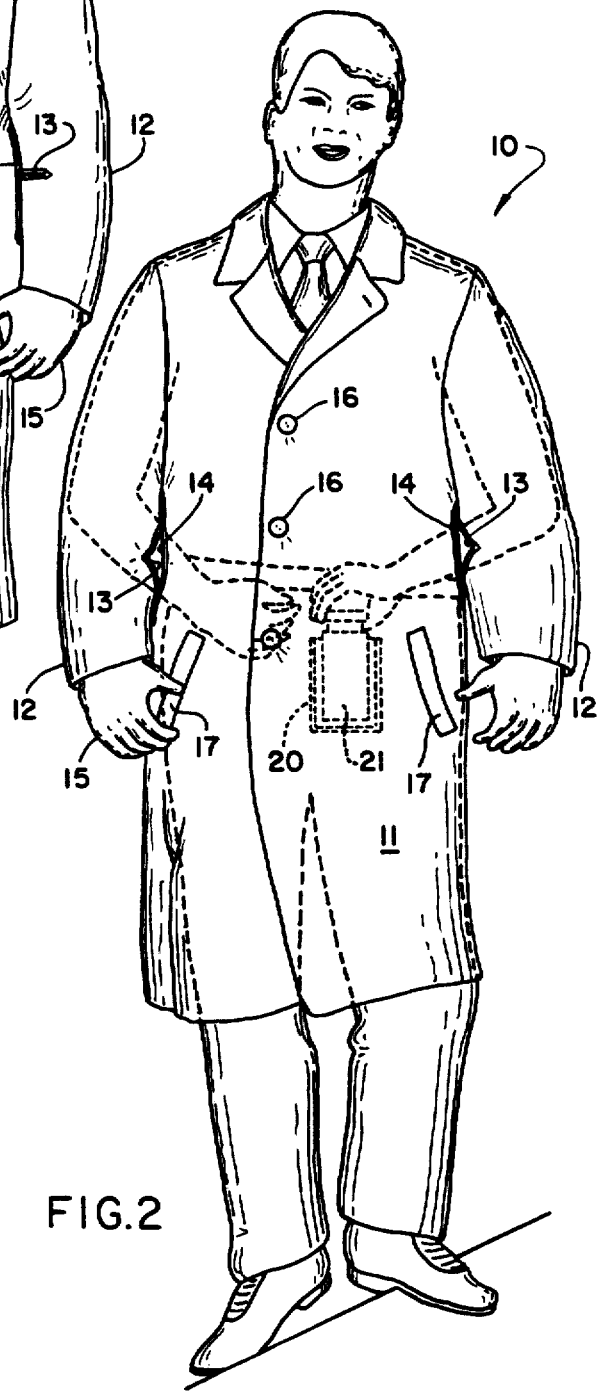
FIG. 2 is an illustration of the garment in use.

FIG. 2 illustrates garment 10 being worn by a person with his hands and forearms within body part 11 of the garment, but giving the appearance of a person wearing a convention topcoat or raincoat with his arms within sleeves 12 and his hands projecting therefrom.

In use, garment 10 would be carried by a man who experiences difficulty in bladder control or who is taking medications that cause frequent urination, and who travels in busy areas that lack "comfort" facilities. When the need for relief arises, and no public toilet or restroom or other facility is available, he can proceed to an inconspicuous place, put on garment 10 by placing his hands and arms in sleeves 12 and out slits 13 and through slits 14 so that his hands and forearms are within the body part of garment 10. He can then relieve himself in private without becoming a public nuisance. To any observer who is not too proximate, garment 10 would cause the user thereof to be seen simply as a pedestrian standing and observing the passing scene. Thus, use of garment 10 would be inconspicuous as compared to the use of a "voluminous cloak" of the type referred to in the aforementioned editorial.

Having thus described the invention, it is apparent that the simulated hand appendages on the garment may be enhanced to appear to show the carrying of a briefcase, or a newspaper, or any other small article. Also, since it is not intended that garment 10 be used under circumstances of close observation, hands 15 and the lower part of sleeves 12 below slits 13 need not be padded. In such case, hands 15 could be folded back or tucked within sleeves 12 and garment 10 worn as a normal outer coat with the wearer's arms fully within sleeves 12 and his hands projecting therefrom. Only when required would the user extend the simulated hands 15 from within sleeves 12 and place his own hands and forearms through slits 13 and 14 and within body part 11 of the garment. If hands 15 are attached to the cuffs of sleeves 12 by snaps or buttons, they may be removed and stored in pocket 17 until needed. Garment 10 could then be used as a regular outer coat until its specialized use is needed. At such time, hands 15 could be appended to sleeves 12 and the garment wearer could extend his hands and forearms through slits 13 and 14 while preserving the illusion of a person standing with his arms at his side and his hands projecting from sleeves 12 of garment 10. Therefore, it is intended that the foregoing description and the accompanying drawing be interpreted as illustrative rather than in a limiting sense.

What is claimed is:

1. A sanitary garment comprising a generally knee-length coat having arm length sleeves and a front opening body part each sleeve being provided with a slit on an inner side thereof adjacent the body part of the coat, said slit extending substantially transversely across the sleeve at the elbow part of the sleeve so that the hands and forearms of a person wearing the coat can exit the sleeves through said sleeve slits, and said body part of the coat being provided with substantially vertical slits adjacent said sleeve slits so that he hands and forearms of a person wearing the coat which have exited the sleeves through said sleeve slits may be inserted through said body part slits whereby a wearer's hands and forearms may be located within the body part of the coat while the wearer's upper arms are within the sleeves of the coat, and at least one simulated hand attached to a bottom of one sleeve, the arrangement being such that when the coat is worn by a person with the person's hands and forearms inside the body part of the coat there is an illusion of a person wearing a conventional coat with at least one hand visible outside the coat.

2. A garment according to claim 1 wherein said body-part of the coat includes a conventional outer pocket so that a bottom part of the sleeve to which a simulated hand is not attached may be tucked therein whereby there is an illusion of a person with one hand in a conventional outer pocket and the other hand visible outside the coat.

3. A garment according to claim 1 wherein said simulated hand is removably attached to said sleeve.

4. A garment according to claim 1 including a second simulated hand attached to a second sleeve of said coat.

5. A garment according to claim 1 wherein said coat includes an internal pocket.

6. The combination of a garment according to claim 5 together with a closable liquid container that is stored in said internal pocket.

* * * * *